US008562291B2

(12) United States Patent
Tan

(10) Patent No.: US 8,562,291 B2
(45) Date of Patent: Oct. 22, 2013

(54) HEAT DISSIPATION DEVICE AND CENTRIFUGAL FAN THEREOF

(75) Inventor: Zeu-Chia Tan, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 702 days.

(21) Appl. No.: 12/875,092

(22) Filed: Sep. 2, 2010

(65) Prior Publication Data

US 2011/0305559 A1 Dec. 15, 2011

(30) Foreign Application Priority Data

Jun. 9, 2010 (TW) ..... 99118743 A

(51) Int. Cl.
*F04D 29/42* (2006.01)

(52) U.S. Cl.
USPC ..... 415/178; 415/206

(58) Field of Classification Search
USPC ..... 415/178, 206; 361/695; 417/423.14
See application file for complete search history.

(56) References Cited

U.S. PATENT DOCUMENTS 6,650,540 B2 * 11/2003 Ishikawa ..... 361/695
7,333,332 B2 * 2/2008 Wang ..... 361/700
7,740,054 B2 * 6/2010 Yang ..... 165/104.33

* cited by examiner

*Primary Examiner* — Ninh H Nguyen
(74) *Attorney, Agent, or Firm* — Altis & Wispro Law Group, Inc.

(57) ABSTRACT

An exemplary heat dissipation device includes a centrifugal fan and a fin assembly. The centrifugal fan includes a fan frame and an impeller mounted in the fan frame. The fan frame includes a base plate, a cover plate and a side wall extending between the base plate and the cover plate. An air outlet is defined in the side wall. The fin assembly is arranged at the air outlet. The cover plate defines an air inlet corresponding to the impeller and forms an air blocking portion near the air outlet. The air blocking portion defines a space therein. A total cross-sectional area of the space of the air blocking portion increases from an inner side of the air blocking portion near the impeller to an outer side of the air blocking portion near the fin assembly, so that the airflow generated by the impeller can be prevented from reflowing back to the impeller from the fin assembly.

19 Claims, 5 Drawing Sheets

HEAT DISSIPATION DEVICE AND CENTRIFUGAL FAN THEREOF

BACKGROUND

1. Technical Field

The disclosure relates to heat dissipation devices, and particularly to a heat dissipation device having a centrifugal fan capable of preventing airflow from reflowing.

2. Description of Related Art

With the continuing improvements in the power of electronic components such as central processing units (CPUs), the heat dissipation requirements of such components are attracting increasing attention. Usually a heat sink is installed on a printed circuit board for cooling an electronic device mounted on the printed circuit board. The heat sink typically includes a heat pipe thermally contacting the electronic device, and a plurality of fins thermally connecting the heat pipe. A centrifugal fan is provided at a side of the fins. The centrifugal fan has an air inlet and an air outlet. The air outlet of the centrifugal fan is in alignment with the side of the fins. The centrifugal fan draws cool air through the air inlet. The cool air under the action of an impeller in the centrifugal fan is blown through and out of the air outlet towards the fins, and turns into hot air. However, in this process, the hot air is prone to reflow back to the impeller of the centrifugal fan from the fins.

What is needed, therefore, is a heat dissipation device with a centrifugal fan which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
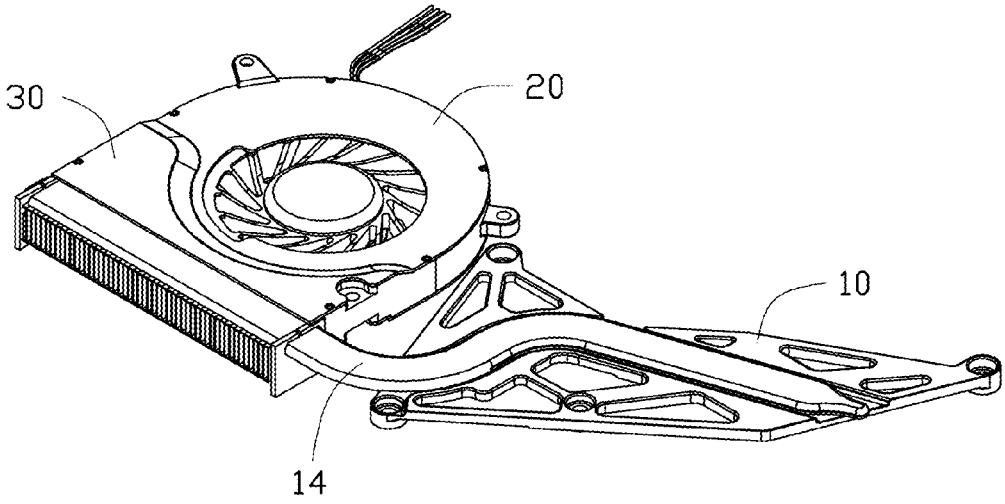
FIG. 1 is an isometric, assembled view of a heat dissipation device in accordance with a first embodiment of the disclosure.
Figure 2:
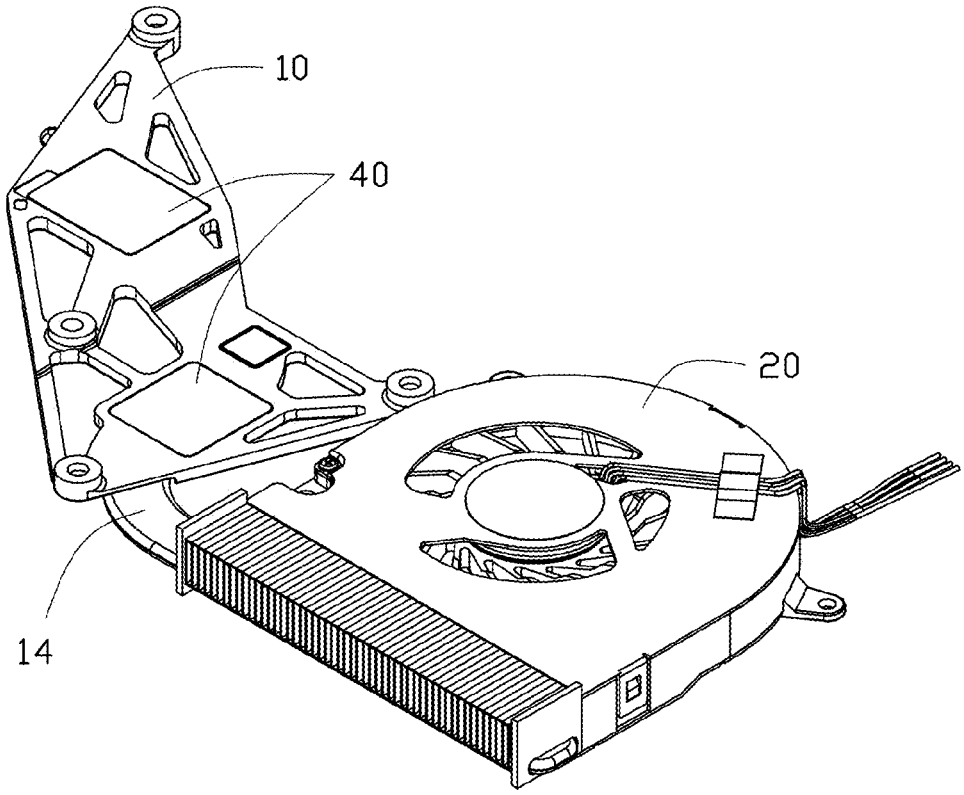
FIG. 2 is a view of the heat dissipation device of FIG. 1, showing the heat dissipation device inverted.

Referring to FIGS. 1 and 2, a heat dissipation device in accordance with a first embodiment of the present disclosure is shown. The heat dissipation device is adapted for simultaneously cooling two electronic devices (not shown) mounted on a printed circuit board (not shown), and includes a heat sink 10 and a centrifugal fan 20.

Figure 3:
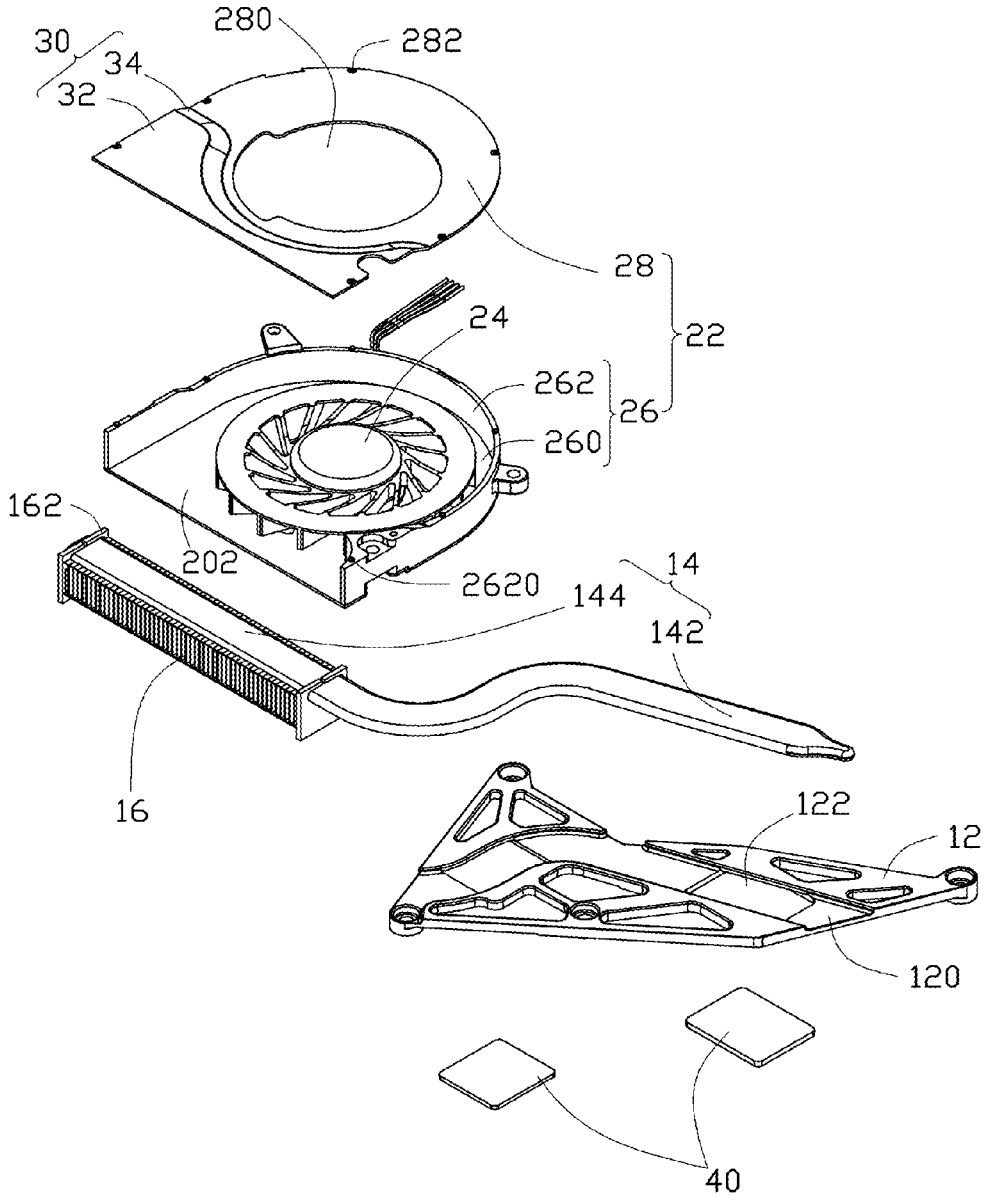
FIG. 3 is an exploded view of the heat dissipation device of FIG. 1.
Figure 4:
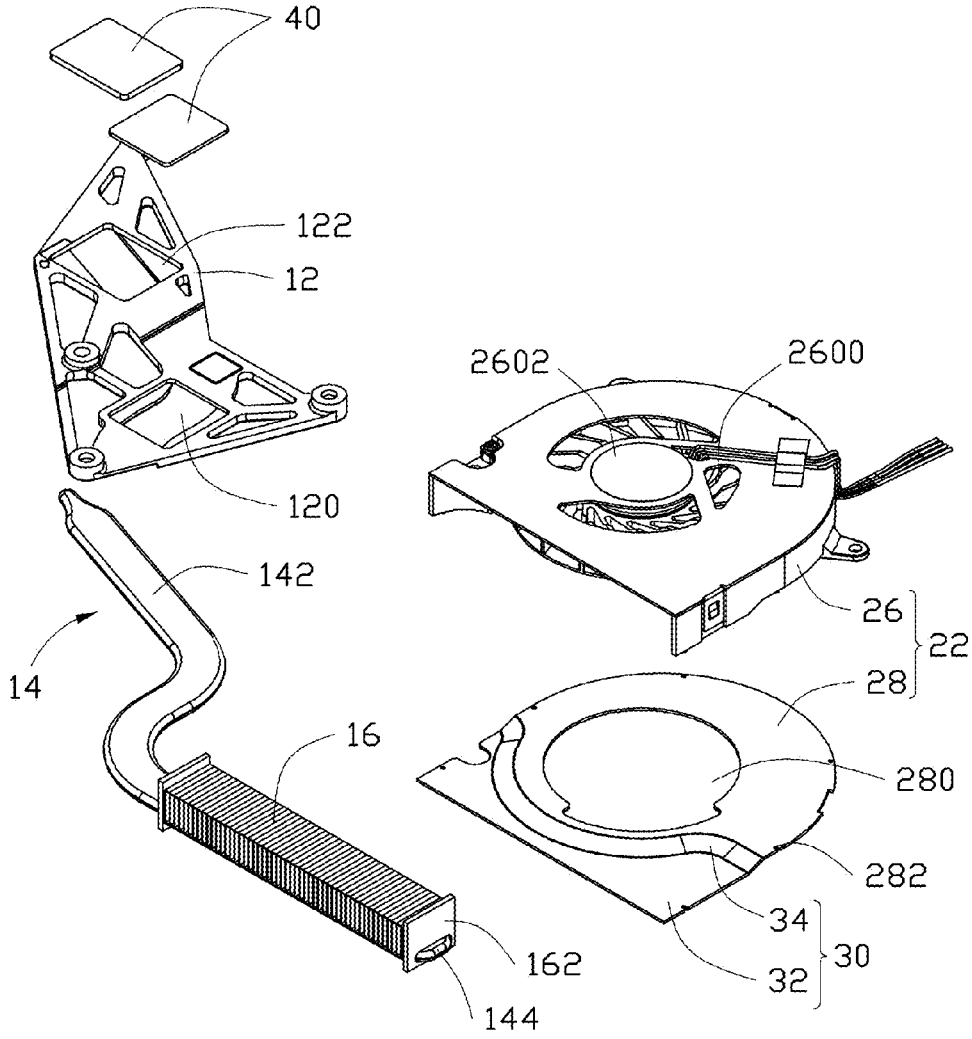
FIG. 4 is a view of the heat dissipation device of FIG. 3, showing the heat dissipation device inverted.

Also referring to FIGS. 3 and 4, the heat sink 10 includes a mounting plate 12 mounted on the printed circuit board, a heat pipe 14, two heat spreaders 40, and a fin assembly 16.

The heat pipe 14 is flat, and includes an evaporating section 142 attached to the mounting plate 12 and a condensing section 144 attached to the fin assembly 16.

The mounting plate 12 and the heat spreaders 40 each are made of metal such as aluminum, copper or an alloy thereof. A channel 120 is defined in a top face of the mounting plate 12, and the evaporating section 142 of the heat pipe 14 is received in the channel 120. Two rectangular grooves 122 are defined in a bottom face of the mounting plate 12, and the two heat spreaders 40 are respectively received in the two grooves 122. The grooves 122 are in communication with the channel 120 of the mounting plate 12, so that a bottom face of the evaporating section 142 of the heat pipe 14 can thermally contact the heat spreaders 40. The heat spreaders 40 thermally contact the two electronic devices respectively to absorb heat from the electronic devices.

The fin assembly 16 includes a plurality of fins (not labeled) stacked together. Two fixing plates 162 are attached to two ends of the fin assembly 16. A fixing hole (not labeled) is defined in a top end of each fixing plate 162. The condensing section 144 of the heat pipe 14 extends through the fixing holes of the fixing plates 162. A bottom face of the condensing section 144 thermally contacts a top face of the fin assembly 16. A plurality of airflow channels are formed between the fins of the fin assembly 16.

The centrifugal fan 20 includes a fan frame 22, and an impeller 24 mounted in the fan frame 22. The fan frame 22 includes a base 26, and a cover plate 28 covering the base 26. A first air inlet 280 is defined in a center of the cover plate 28. A plurality of through holes 282 is defined in a periphery of the cover plate 28. The base 26 includes a base plate 260, and a side wall 262 extending vertically upwardly from an outer edge of the base plate 260. The base plate 260 includes a fixing seat 2602 at a center thereof. Three second air inlets 2600 are defined in the base plate 260 around the fixing seat 2602, corresponding to the first air inlet 280 of the cover plate 28. The impeller 24 is fixed on the fixing seat 2602 of the base plate 260. An air outlet 202 is defined in the side wall 262 of the base 26. A plurality of fixing holes 2620 are defined in a top face of the side wall 262, corresponding to the through holes 282 of the cover plate 28. Screws (not shown) extend through the through hole 282 of the cover plate 28 and are screwed into the fixing holes 2620 of the side wall 262 to fasten the cover plate 28 on the side wall 262. Thereby, the cover plate 28 and the base 26 cooperatively form a space (not labeled) where the impeller 24 is received.

An air blocking portion 30 integrally extends from a side of the cover plate 28 nearest the fin assembly 16. The air blocking portion 30 protrudes upwardly and outwardly from the side of the cover plate 28 and extends to the fin assembly 16. In particular, the air blocking portion 30 includes a planar main body 32 and a slantwise portion 34. The slantwise portion 34 extends from the cover plate 28, and the main body 32 extends from the slantwise portion 34 to the air outlet 202. The main body 32 is located at a level above the level of the cover plate 28, and at a same level as the top face of the fin assembly 16. In this embodiment, the air blocking portion 30 has an approximate "C" shape when viewed from above. The main body 32 and the slantwise portion 34 cooperatively define a space therebetween, and a part of the space immediately below the main body 32 has a uniform height. With this configuration, a total transverse cross-sectional area of the space of the air blocking portion 30 increases from an inner side of the air blocking portion 30 near the impeller 24 to an outer side of the air blocking portion 30 near the fin assembly 16. Accordingly, the airflow generated by the impeller 24 can be prevented from reflowing back to the first air inlet 280 from the air outlet 202.

During operation of the heat dissipation device, the heat spreaders 40 absorb heat generated from the electronic devices, and the heat pipe 14 transfers heat in the heat spreaders 40 to the fin assembly 16. The centrifugal fan 20 draws air through the first air inlets 280 and the second air inlet 2600 into the space formed by the cover plate 28 and the base 26. The air under the action of the impeller 24 is blown through and out of the fin assembly 16. The total cross-sectional area of the space of the air blocking portion 30 increases from the inner side of the air blocking portion 30 near the impeller 24 to the outer side of the air blocking portion 30 near the fin assembly 16. Therefore the airflow generated by the impeller 24 can be prevented from reflowing back to the first air inlet 280 from the air outlet 202. Thus a higher heat dissipation efficiency of the heat dissipation device is achieved.

Figure 5:
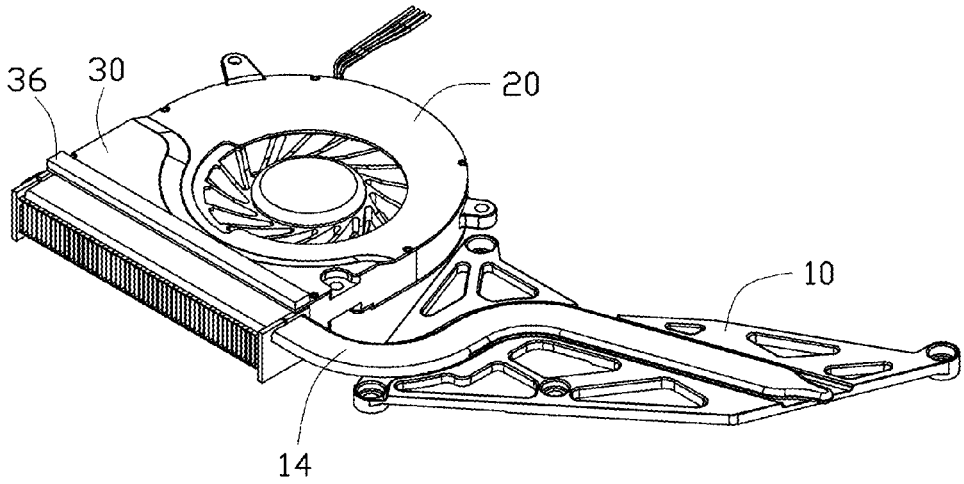
FIG. 5 is an isometric, assembled view of a heat dissipation device in accordance with a second embodiment of the disclosure.

Referring to FIG. 5, a heat dissipation device in accordance with a second embodiment of the present disclosure is shown. The difference between the second embodiment and the first embodiment is that in the second embodiment, the air blocking portion 30 further includes a baffle bar 36 disposed on the main body 32. The baffle bar 36 is made of rubber and located between the air outlet 202 and the first air inlet 280, so that the airflow generated by the impeller 24 can be further prevented from reflowing back to the first air inlet 280 from the air outlet 202.

It is believed that the embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A heat dissipation device comprising:
a centrifugal fan comprising:
a fan frame comprising:
a base plate;
a cover plate; and
a side wall extending between the base plate and the cover plate, an air outlet being defined in the side wall; and
an impeller mounted in the fan frame; and
a fin assembly arranged at the air outlet;
wherein the cover plate defines a first air inlet corresponding to the impeller and forms an air blocking portion near the air outlet, the air blocking portion defines a space therein, and a total cross-sectional area of the space of the air blocking portion increases from an inner side of the air blocking portion near the impeller to an outer side of the air blocking portion near the fin assembly.

2. The heat dissipation device of claim 1, wherein the air blocking portion protrudes outwardly from the cover plate along an axial direction of the impeller.

3. The heat dissipation device of claim 2, wherein the air blocking portion is integrally formed on the cover plate and extends from near the first air inlet to near the fin assembly.

4. The heat dissipation device of claim 3, wherein the air blocking portion comprises a planar main body near the air outlet and a slantwise portion located near the first air inlet and connecting the main body with the cover plate.

5. The heat dissipation device of claim 4, wherein the main body is located at a same level as the fin assembly.

6. The heat dissipation device of claim 4, wherein the air blocking portion further comprises a baffle bar disposed on the main body.

7. The heat dissipation device of claim 6, wherein the baffle bar is made of rubber.

8. The heat dissipation device of claim 4 further comprising a heat pipe and a heat spreader, an end of the heat pipe connecting the fin assembly, another end of the heat pipe connecting the heat spreader.

9. The heat dissipation device of claim 4, wherein the fin assembly comprises a plurality of fins stacked together, and a plurality of airflow channels are formed between the fins.

10. The heat dissipation device of claim 4, wherein the base plate comprises a fixing seat at a center thereof, and the impeller is fixed on the fixing seat.

11. The heat dissipation device of claim 10, wherein a plurality of second air inlets are defined in the base plate around the fixing seat, corresponding to the first air inlet of the cover plate.

12. A centrifugal fan comprising:
a fan frame comprising:
a base plate;
a cover plate; and
a side wall extending between the base plate and the cover plate, an air outlet being defined in the side wall; and
an impeller mounted in the fan frame;
wherein the cover plate defines a first air inlet corresponding to the impeller and forms an air blocking portion near the air outlet, the air blocking portion defines a space therein, and a total cross-sectional area of the space of the air blocking portion increases from an inner side of the air blocking portion near the impeller to an outer side of the air blocking portion near the air outlet.

13. The centrifugal fan of claim 12, wherein the air blocking portion is integrally formed on the cover plate and extends from near the first air inlet to near the air outlet.

14. The centrifugal fan of claim 13, wherein the air blocking portion comprises a planar main body near the air outlet and a slantwise portion located near the first air inlet and connecting the main body with the cover plate.

15. The centrifugal fan of claim 14, wherein the air blocking portion further comprises a baffle bar disposed on the main body.

16. The centrifugal fan of claim 15, wherein the baffle bar is made of rubber.

17. The centrifugal fan of claim 14, wherein the base plate comprises a fixing seat at a center thereof, and the impeller is fixed on the fixing seat.

18. The centrifugal fan of claim 17, wherein a plurality of second air inlets are defined in the base plate around the fixing seat, corresponding to the first air inlet of the cover plate.

19. A heat dissipation device comprising:
a centrifugal fan comprising:
a fan frame comprising:
a base plate;
a cover plate; and
a side wall extending between the base plate and the cover plate, an air outlet being defined in the side wall; and
an impeller mounted in the fan frame; and
a fin assembly arranged at the air outlet;
wherein the cover plate comprises a main portion corresponding to the impeller and an air blocking portion extending from a side of the main portion to the air outlet, the main portion defines an air inlet corresponding to the impeller, the air blocking portion is located at a level higher than that of the main portion, and the air blocking portion is generally C shaped as viewed from a top of the cover plate, with the inner side of the C shape of the air blocking portion adjoining the main portion;

whereby a total cross-sectional area of a space inside the fan frame at the air blocking portion increases from an inner side of the air blocking portion at the main portion to an outer side of the air blocking portion at the fin assembly.

* * * * *